US006488433B2

(12) United States Patent
Wien et al.

(10) Patent No.: US 6,488,433 B2
(45) **Date of Patent: *Dec. 3, 2002**

(54) BINDER WITH RECLOSABLE OUTER TRANSPARENT WINDOW

(75) Inventors: Thomas Wien, Newport Beach, CA (US); Norman C. Yamamoto, Yorba Linda, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/080,757

(22) Filed: Feb. 22, 2002

(65) Prior Publication Data

US 2002/0074791 A1 Jun. 20, 2002

Related U.S. Application Data

(63) Continuation of application No. 09/333,096, filed on Jun. 15, 1999, now Pat. No. 6,367,842.

(51) Int. Cl.[7] ..... B42F 13/00

(52) U.S. Cl. ..... 402/73; 150/145; 281/29; 281/31; D19/26

(58) Field of Search ..... 281/29, 31, 37; 402/70, 73; 150/145; 206/776; D19/26, 27, 32

(56) References Cited

U.S. PATENT DOCUMENTS

| | | | | | |
|---|---|---|---|---|---|
| 1,696,629 | A | | 12/1928 | Fenno | |
| 1,832,715 | A | | 11/1931 | London | |
| 2,716,985 | A | * | 9/1955 | Wolf | 281/16 |
| 2,755,837 | A | * | 7/1956 | Kosek | 190/901 |
| 2,852,275 | A | | 9/1958 | Brook | |
| 3,241,863 | A | | 3/1966 | Paddack | |
| 4,629,349 | A | * | 12/1986 | Pitts | 281/31 |
| 5,160,001 | A | * | 11/1992 | Marceau | 190/102 |
| 5,219,437 | A | * | 6/1993 | Moor et al. | 281/29 |
| 5,330,279 | A | | 7/1994 | Ruble | |
| 5,411,293 | A | | 5/1995 | Monzyk | |
| D365,361 | S | | 12/1995 | Smith et al. | |
| 5,711,627 | A | * | 1/1998 | Chapman | 281/29 |
| 5,720,564 | A | | 2/1998 | Winzen | |
| 5,857,797 | A | * | 1/1999 | Streff et al. | 281/31 |
| 5,876,143 | A | * | 3/1999 | Ong | 281/29 |
| 5,911,441 | A | * | 6/1999 | Yamamoto et al. | 281/15.1 |
| 6,086,106 | A | * | 7/2000 | Joe et al. | 206/37 |
| 6,367,842 | B1 | * | 4/2002 | Wien et al. | 150/145 |

* cited by examiner

*Primary Examiner*—A. L. Wellington
*Assistant Examiner*—Monica Carter
(74) *Attorney, Agent, or Firm*—Oppenheimer Wolff & Donnelly, LLP

(57) ABSTRACT

A covered binder assembly in accordance with one exemplary embodiment of the present inventions includes a front cover, a rear cover, and a spine connecting the front and rear covers. The front cover has a window assembly including a transparent sheet mounted thereto. The front cover may be transparent to allow the user to see through front cover into the interior of the binder. The trasparent sheet spans substantially over the front cover to form a front cover pocket between the cover and the transparent sheet. An opening is extended along a comer between the front cover and the spine to provide access to the front cover pocket. A closure arrangement is provided to facilitate the closing of the opening. A second thin transparent sheet forms a spine pocket between the spine and the second transparent sheet. The opening along the corner between the front cover and the spine also provides access to the spine pocket. The window assembly may have additional sheet material secured thereto to provide small pockets, and may be pivoted outward from the cover to provide access to insert visual material into the small pockets.

14 Claims, 7 Drawing Sheets

BINDER WITH RECLOSABLE OUTER TRANSPARENT WINDOW

RELATED PATENT APPLICATION

This is a continuation of U.S. patent application Ser. No. 09/333,096, filed Jun. 15, 1999 (Docket 310048-427) now U.S. Pat. No. 6,367,842, granted Apr. 9, 2002.

FIELD OF THE INVENTION

The present invention relates to binders, and more particularly, to binders with transparent front windows to accommodate a visual display.

BACKGROUND OF THE INVENTION

Binders with transparent spine and front cover pockets are available in the prior art. For example, U.S. Pat. No. 5,857,797, issued to Streff et al. (hereinafter Streff), discloses a three-ring binder which includes a spine, front cover and back cover. Each of the spine, front cover, and back cover has a substantially solid base plate and an outer plastic shell. The spine and front cover each includes a rectangular picture frame with outer edges aligned with and bonded to the bottom and side edges of the spine and cover. A clear plastic membrane is secured to the interior of the frame to cover the opening in the picture frame. The top edges of the frame are spaced inwardly and free of the outer plastic shell on the spine and front cover to form insert pockets. A user may insert a visual display sheet or other paper-like or card-like objects in these insert pockets.

As another example, U.S. Pat. No. 5,720,564, issued to Winzen, discloses a binder which has a front cover, a rear cover, a spine. The Winzen patent also discloses a transparent label holder which extends across the spine and is attached to at least one of the covers. Accordingly, information or visual display sheets may be carried on the front cover as well as the spine.

However, the Streff and the Winzen binders do not include a mechanism for securing the information or visual display sheets once they are inserted in the spine and front cover pockets. Furthermore, the Streff and the Winzen binders are not designed so as to provide a user with a view of the objects contained within the interior of the binders.

SUMMARY OF THE INVENTION

A binder assembly in accordance with one exemplary embodiment of the present inventions includes a front cover, a rear cover, and a spine connecting the front and rear covers. The front cover has a transparent sheet mounted on the cover. The transparent sheet spans substantially over the cover to form a front cover pocket. An opening extends along a comer between the front cover and the spine to provide access to the front cover pocket. A closure arrangement is provided to facilitate the closing of the opening.

In accordance with one aspect of the invention, the base plate of the front cover is substantially stiff or rigid. In one embodiment, the base plate is trasparent to allow the option of permitting the user to see through the front cover into the interior of the binder. However, the base plate may also be made of opaque material.

In accordance with another aspect of the invention, the spine includes an inner support interconnecting said front and rear covers. A second the transparent sheet overlies said inner support and forms a spine pocket between the inner support and the second transparent sheet. The opening along the corner between the front cover and the spine also provides access to the spine pocket.

In accordance with yet another aspect of the invention, transparent rectangular areas of sheet material are bonded to the first transparent sheet on the front cover to form small transparent pockets. These transparent pockets may be either on the outside or the inside of the transparent sheet. When they are mounted on the inside, a zipper or other closure may extend around three sides of the transparent sheet, so that it may be raised up from the cover to give access for inserting visual material into the small pockets.

In accordance with one specific illustrative embodiment of the invention, a binder having front and rear covers pivotally secured to a spine, also has a window assembly secured to the front cover, with the window assembly having a transparent layer and a peripheral frame or binding around the edge of the transparent layer. At least one side of the window assembly is permanently secured to one side of the front cover, and the remainder of the periphery of the window assembly is releasably secured to the periphery of the front cover to permit the insertion of visual material, and to provide a high strength unitary binder following securing of the window assembly to the front cover.

In one preferred embodiment of the arrangements described in the preceding paragraph, additional strips of transparent sheet material are secured to the inner surface of said transparent layer to provide small inner pockets for display material, and the window assembly may be pivoted away from the front cover to permit the insertion of visual material into the small inner pockets. A zipper extending around three sides of the window assembly may be employed to selectively secure the window assembly to the front cover of the binder.

The above described and many other features and attendant advantages of the present invention will become apparent as the invention becomes better understood by reference to the following detailed description when considered in conjunction with the accompanying drawings.

DETAILED DESCRIPTION OF THE PREFERRED EMBODIMENTS

Figure 1:
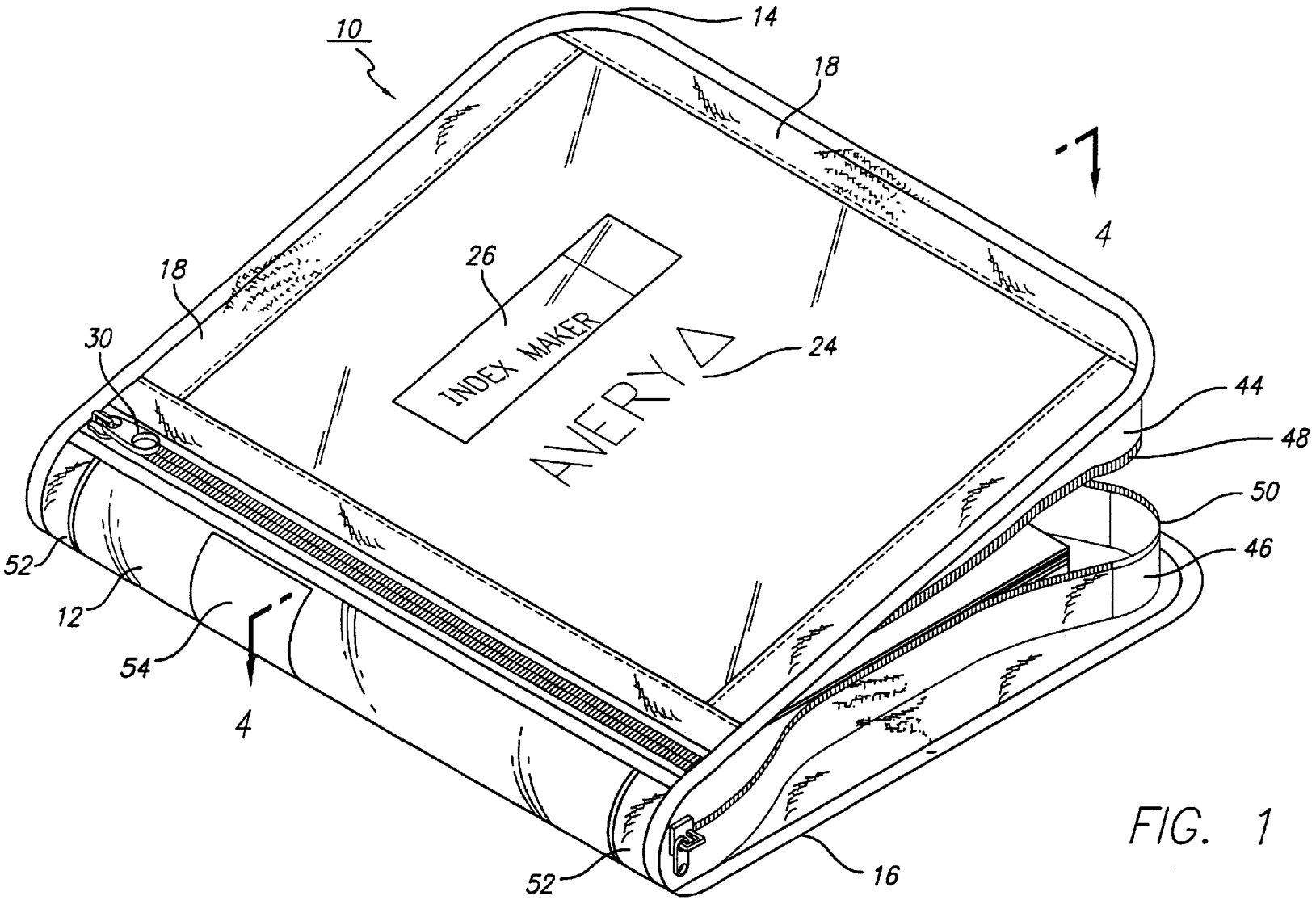
FIG. 1 is a perspective view of an exemplary binder in the closed position.
Figure 2:
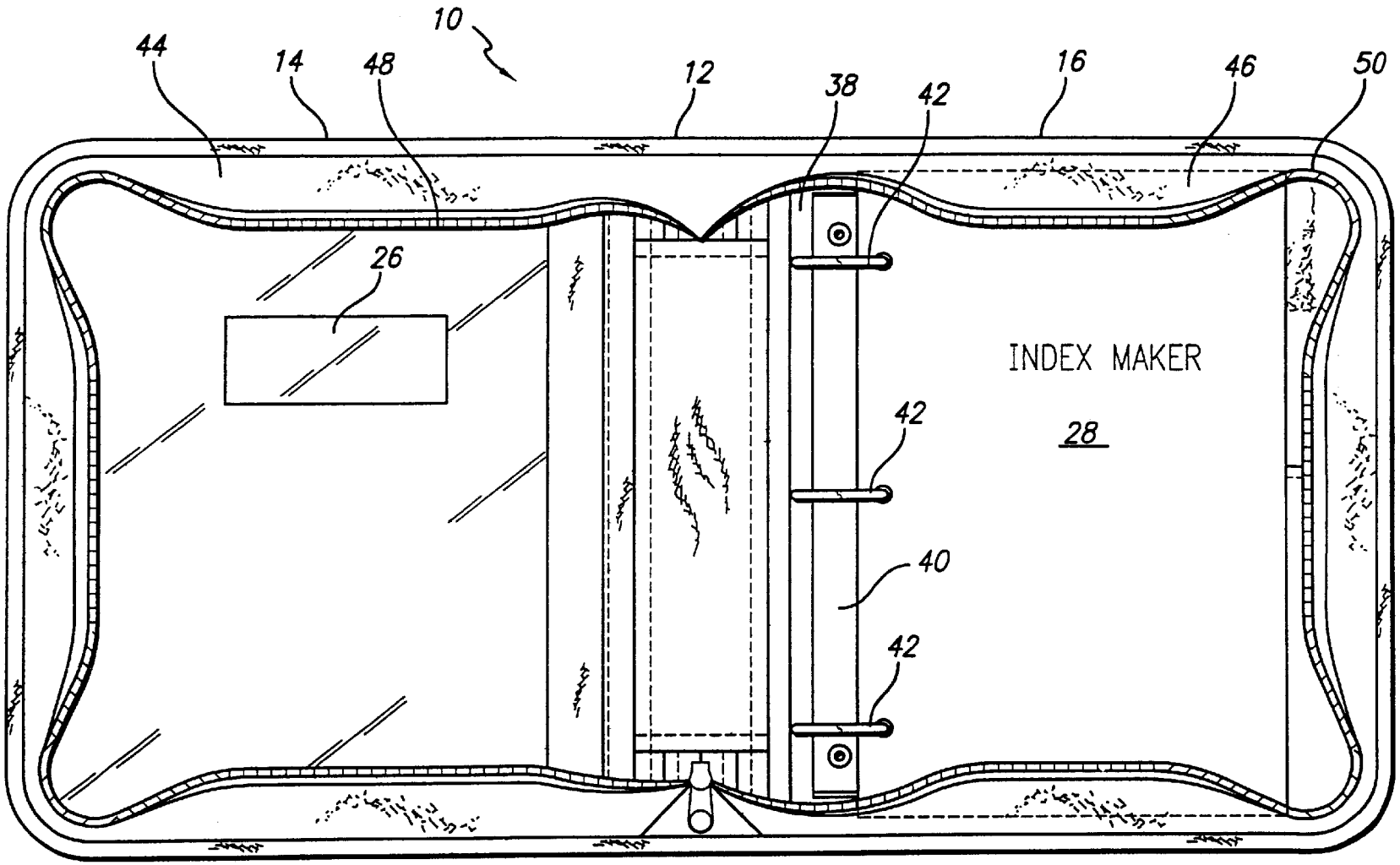
FIG. 2 shows a perspective view of an exemplary binder in the opened position.
Figure 3:
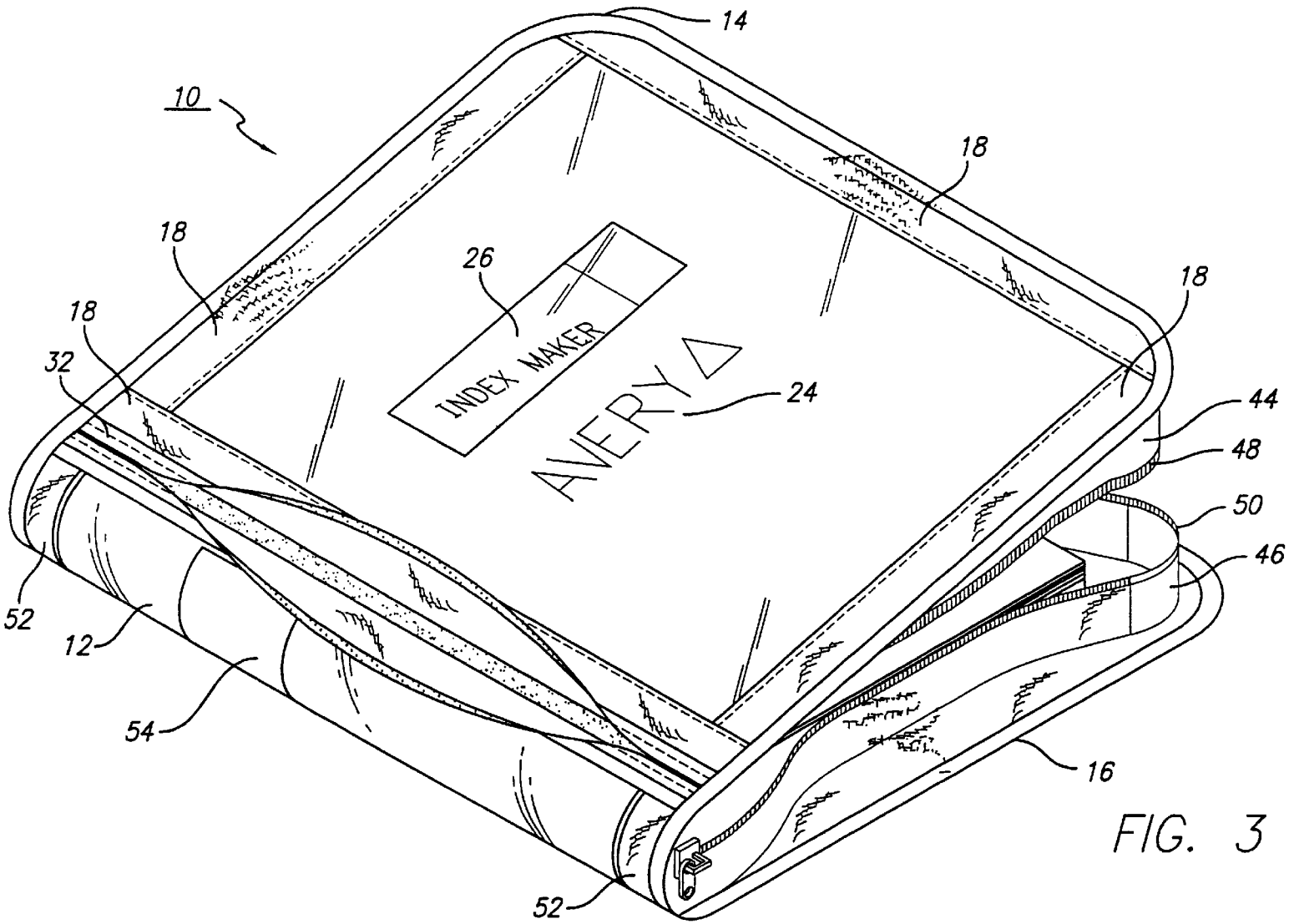
FIG. 3 is a perspective view of an exemplary binder in the closed position as shown in FIG. 1, but with the closure arrangement being layers of mating hook and loop material.

FIGS. 1, 2, and 3 show an exemplary binder 10 constructed to hold standard size sheets of eight and a half inches by eleven inches. The binder 10 includes a spine 12, a front cover 14, and a rear cover 16 connected to the opposite edges of the spine 12. The front and rear covers 14,16 have a preferred width of about eleven inches and height of about thirteen inches. The binder 10 may also be sized to accommodate paper sheets larger or smaller than eight and a half inches by eleven inches. For example, typical carry-type organizers and calendars are usually about five inches by seven inches, while binders for photo albums can be about twelve inches by fifteen inches.

Figure 4:
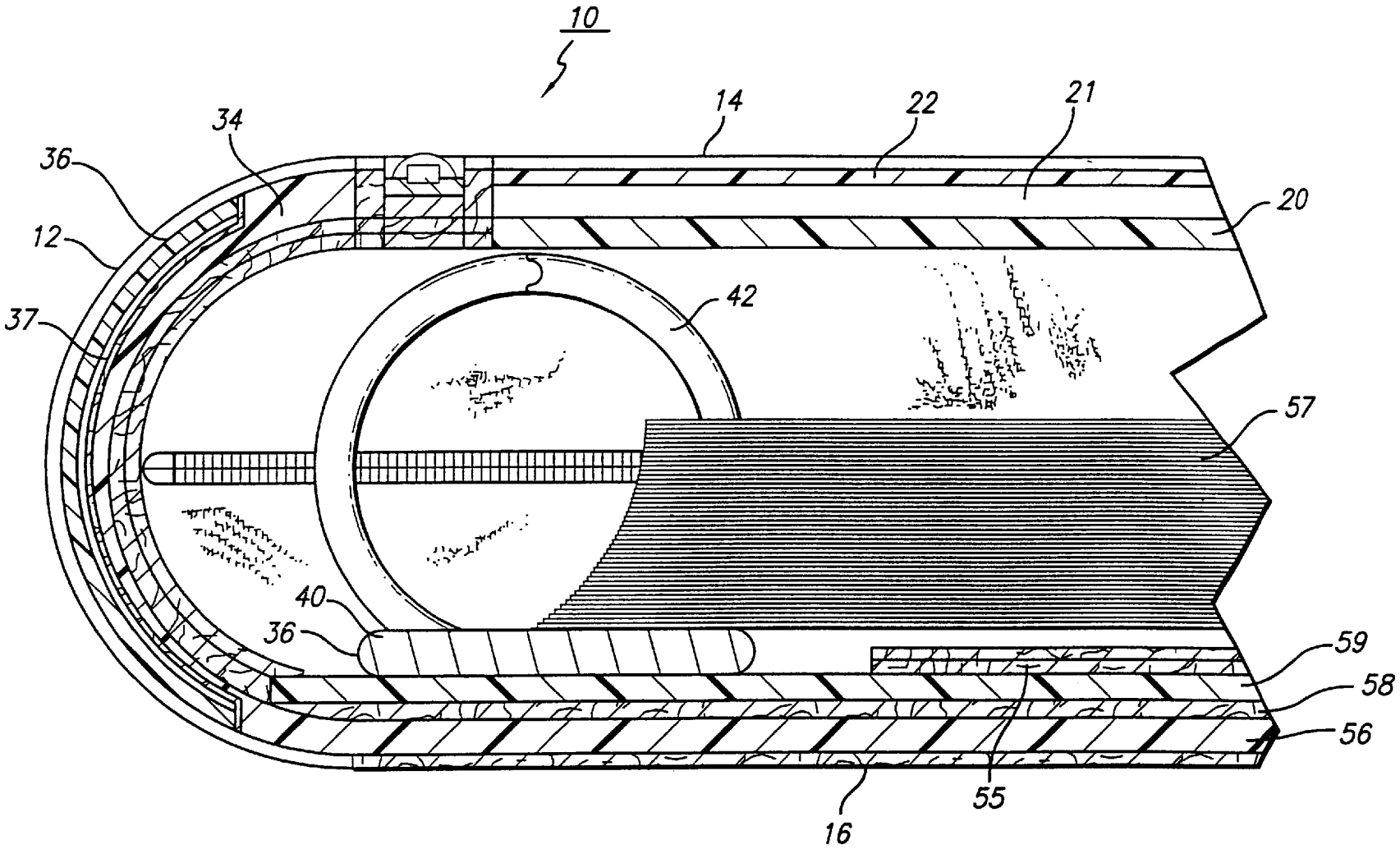
FIG. 4 shows a cross-sectional view of an exemplary binder taking along line 4—4 of FIG. 1.
Figure 5:
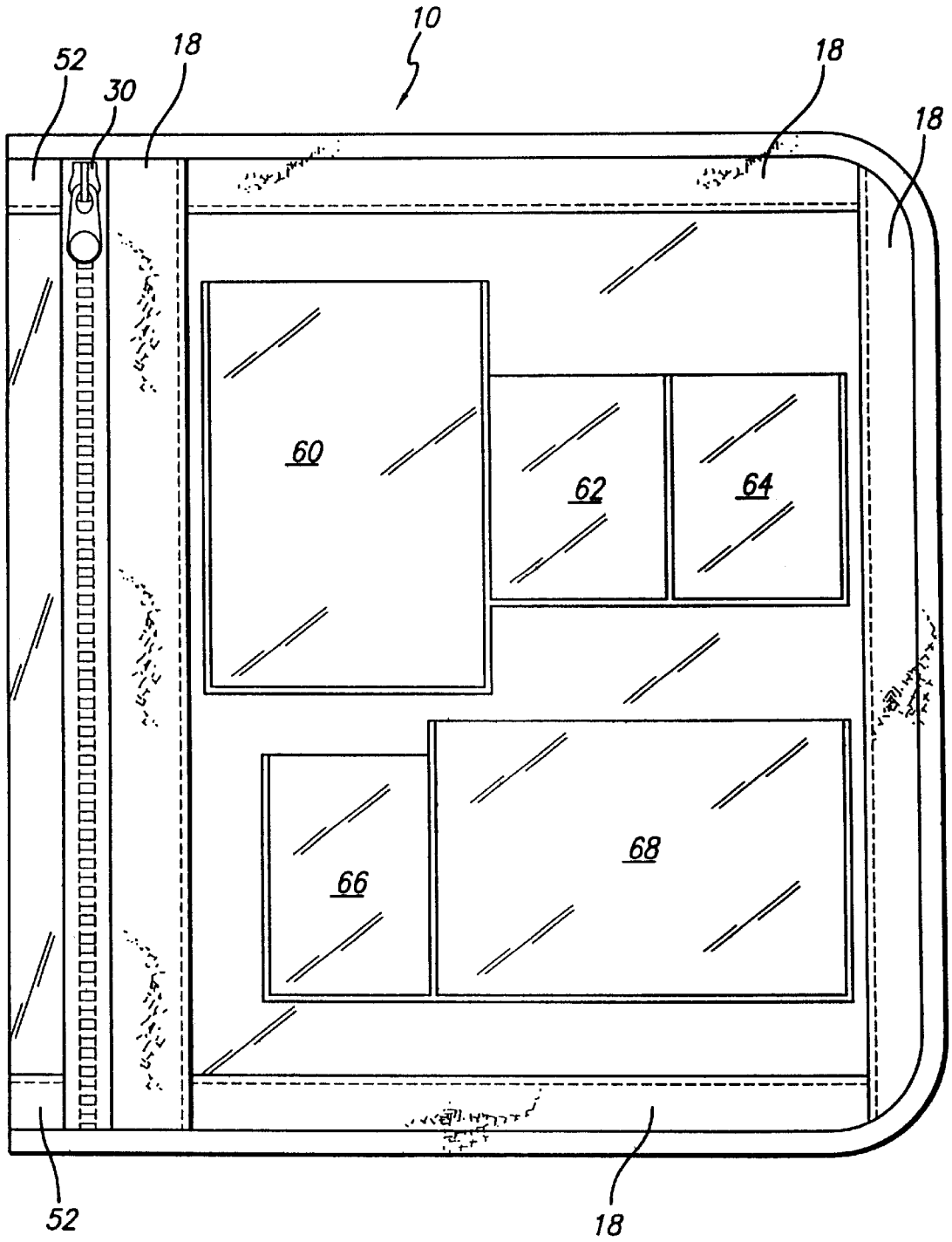
FIG. 5 is a top plan view of an alternative binder with transparent rectangular areas secured to the front cover to form small transparent pockets.

The front cover 14 has fabric covered edges 18 to form a front cover frame as shown in FIGS. 1, 3, and 5. As shown in FIG. 4, the front cover 14 includes a substantially stiff or rigid inner base plate 20, which may be either transparent or opaque. The base plate 20 extends substantially throughout the entire width and height of the front cover 14, and is preferably transparent to allow a user to look through the front cover 14 into the interior of the binder 10. In one preferred embodiment, the base plate 20 is formed of polypropylene and has a thickness of about 30 mils or 0.030 inch. In practice, the base plate 20 may be constructed using any transparent or opaque and substantially stiff or rigid material that may differ substantially in thickness.

As stated above, strips of fabric are bonded to the edges 18 of the front cover 14 to form a front cover frame. A thin transparent sheet 22 is bonded to the base plate 20 and is secured to the inner surfaces of the fabric forming the front cover frame. As depicted in FIG. 4, the transparent sheet 22 forms a front cover pocket 21 to receive visual displays or other information sheets. In the preferred embodiment, the transparent sheet 22 is formed of polyvinyl chloride which is about 0.007 inch thick. However, the sheet 22 may also be formed of other transparent plastic material such as polyolefin material. It is contemplated that the transparent sheet 22 may be in the preferred range of 0.004 to 0.015 inch thick.

An exemplary use of the pocket is demonstrated in FIGS. 1, 2, and 3. As shown in FIGS. 1 and 3, a first visual display sheet with the "Avery" indicia and logo may be inserted into the front cover pocket 21. The first visual display sheet 24 may have a window 26 so that a user may look through the window 26 and see objects placed inside the binder 10. A second visual display sheet 28 with the "Index Maker" writing may be inserted inside the binder 10 as the top sheet secured in the binder, as depicted in FIG. 2. The "index Maker" writing may be aligned with the window 26 on the first visual display sheet 24, such that when a user looks through the window, the writing would appear in the user's view.

The front cover pocket 21 may be selectively opened or closed by a pocket closure arrangement 30. In the preferred embodiment, the closure arrangement 30 extends along a corner between the spine 12 and the front cover 14 to provide access to the front cover pocket 21. In practice, the closure arrangement 30 may extend along any side of the front cover 14. The closure arrangement 30 can be a Zipper, as shown in FIG. 1, or mating layers of hook and loop material 32, as depicted in FIG. 3. When the closure arrangement 30 is opened, the user may access the front cover pocket 21 to insert a visual display or information sheet 24 in the pocket 21. Once the visual display or information sheet 24 is inserted in the pocket 21, the user may seal the closure arrangement 30, thereby securing the sheet 24 within the pocket 21.

As stated above, the binder 10 has a spine 12 which includes an inner support 34 connecting the front cover 14 and rear cover 16, as shown in FIG. 4. The spine 12 includes strips of fabric covering the edges 52 of the spine 12 to form a spine frame. A thin transparent sheet 36 is bonded to the inner support 34 to form a spine pocket 37 between the inner support 34 and the transparent sheet 36, as shown in FIG. 4, to receive a visual display or information sheet or card 54. The transparent sheet 36 may be formed of polyvinyl chloride which is about 0.007 inch thick. However, the sheet 36 may also be formed of other transparent plastic material such as polyolefin material. It is contemplated that the transparent sheet 36 may be in the preferred ranze of 0.004 to 0.015 inch thick. In the preferred embodiment, the closure arrangement 30, which extends alone the corner between the front cover 14 and the spine 12, provides access to the spine pocket 37 as well as to the front cover pocket 21. When the closure arrangement 30 is opened, the user can insert a visual display or information sheet or card 54 in the spine pocket, as shown in FIGS. 1 and 3. Once the visual display or information sheet or card 54 is inserted in the spine pocket, the user may seal the closure arrangement 30, thereby securing the sheet or card 30 within the pocket.

As depicted in FIG. 4, the rear cover 16 of the binder preferably includes a substantially stiff or rigid inner base plate 56, which is covered by a fabric layer 58. A piece of fabric 55 is stitched to the fabric layer 58 covering the rear cover 16 to form an interior pocket for receiving a paper ring insert 38. The paper ring insert 38 comprises of a base 59 and a paper ring mechanism 40 mounted on the base 59. In assembling the binder 10, the base 59 of the paper ring insert 38 may be inserted into the interior pocket formed by the fabric 55, such that the paper ring mechanism 40 is placed adjacent to the spine 12, as shown in FIG. 2. The paper ring mechanism 40 preferably includes rings 42 that can be opened to receive papers or sheet-like objects 57 having spaced holes along their inner edges for alignment with the rings, as depicted in FIG. 4. The paper ring mechanism 40 may be formed of a metal such as steel or light weight and inexpensive material such as plastic.

As shown in FIGS. 1, 2, and 3, the front cover 14 may be selectively sealable to the rear cover 16 by a binder closure Zipper 48,50 to open or close the binder 10. As shown in FIGS. 1, 2, and 3, the side edge of the front cover 14 is connected to an outer side wall 44, and the side edge of the rear cover 16 is connected to an outer side wall 46. Each of the outer side walls 44,46 of the front and rear covers 14,16 has an outer edge, 48 and 50, respectively. The outer edge 48,50 of each outer side wall 44,46 has one corresponding side of a Zipper 48,50 attached thereto. When the side of the Zipper 48 of the outer side wall 44 of the front cover 14 is engaged to the side of the Zipper 50 of the outer side wall 46 of the rear cover 16, the binder 10 is in its closed configuration, and the papers or sheet-like objects are safely contained within the interior of the binder 10. When the user disengages the Zipper connecting the outer side walls 4,46 of the front and rear covers 14,16, the binder 10 may be opened.

Referring now to FIG. 5, an alternative embodiment of a binder 10 is illustrated. A layer of rectangular areas of transparent material are bonded to the thin transparent sheet of the front cover to form a plurality of small pockets 60–68 that vary in size. The construction of the small pockets 60–68 are disclosed in pending U.S. patent application No. 09/156,242, which was filed on Sep. 18, 1998 and entitled "Double Vision Cover and Binder Assembly."

As depicted in FIG. 5, a first row of small pockets includes the first pocket 60 having a width of about four inches and a height of about six inches, and second and third small pockets 62,64 each having a width of about two and one fourth inches and a height of about three and a half inches. The second row of small pockets includes the fourth small pocket 66 having a width of a bout two and a half inches and a height of about three and a half inches, and the fifth small pocket 68 having a width of about six inches and a height of about four inches.

The small pockets 60–68 depicted in FIG. 5 are generally formed by cutting rectangular areas of transparent material and by suitably securing the three edges of the area onto the transparent sheet 22 which is bonded to the front cover 14. The top side of each small pocket 60–68 is left unsecured to the transparent sheet 22 to define a top insert opening. The transparent sheet 22 may be bonded to the base plate of the front cover 14 before or after the small pockets 60–68 are bonded to the transparent sheet.

Figure 6:
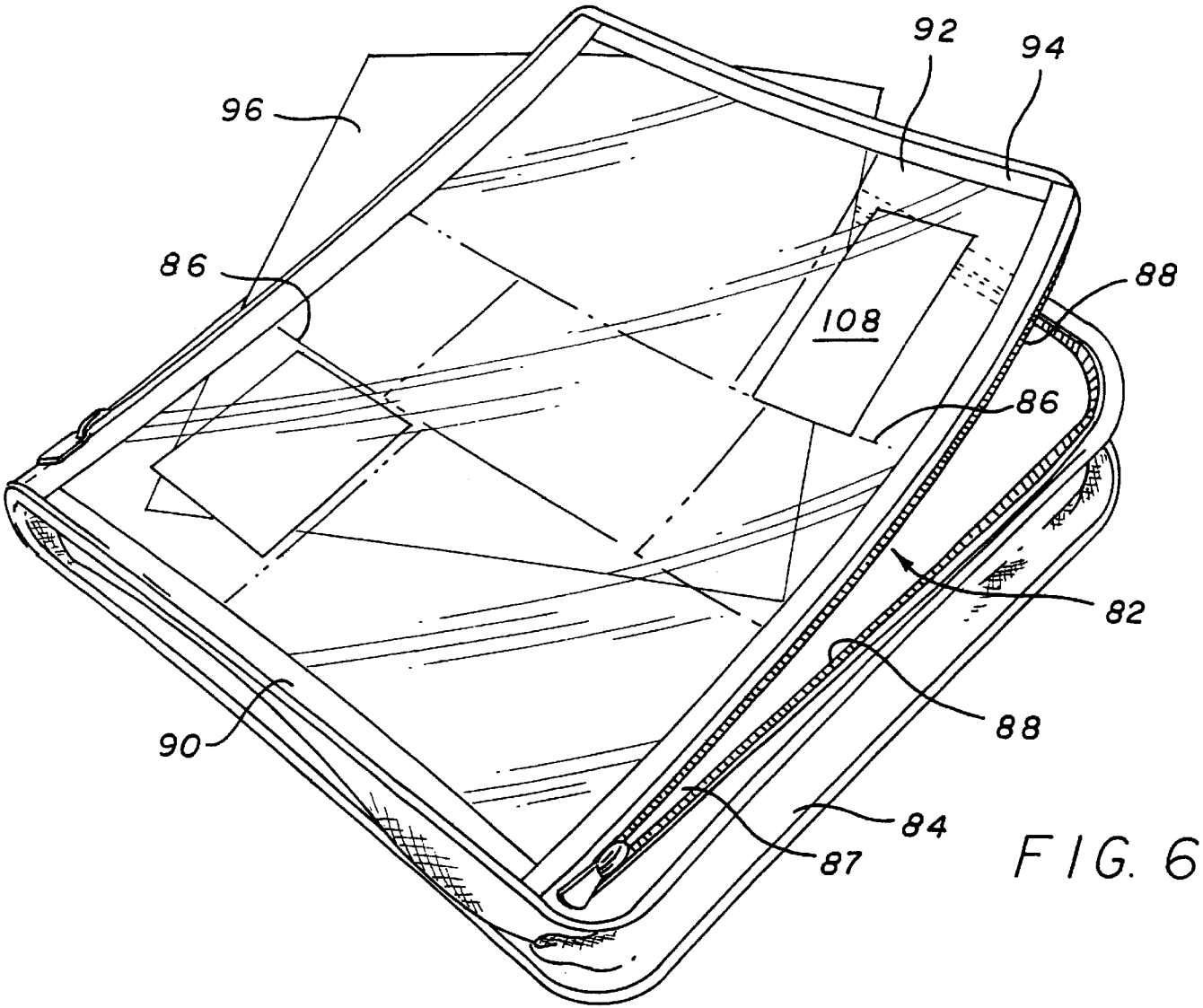
FIG. 6 is a perspective view of another alternative embodiment of the invention.

FIG. 6 shows a further alternative embodiment of the invention in which a binder assembly 82 includes a main, generally conventional binder section 84 and an outer window assembly 86 which is mounted on the front cover 87 of the binder assembly by a zipper 88 extending along two sides and the top of the window assembly 86. The lower edge 90 of the window assembly 86 is permanently secured to the lower edge of the front cover 87 of the binder.

The outer window assembly 87 includes a central flexible transparent sheet 92 surrounded by and secured to a peripheral binding strip 94. A large visual display sheet 96 may be inserted into the space between the front cover 87 and the window assembly 86 by unzipping the window assembly 86 on three sides. Following insertion of the display material 96, the zipper may be closed, with the edge binding strip forming a frame or outer border for the display material.

Figure 7:
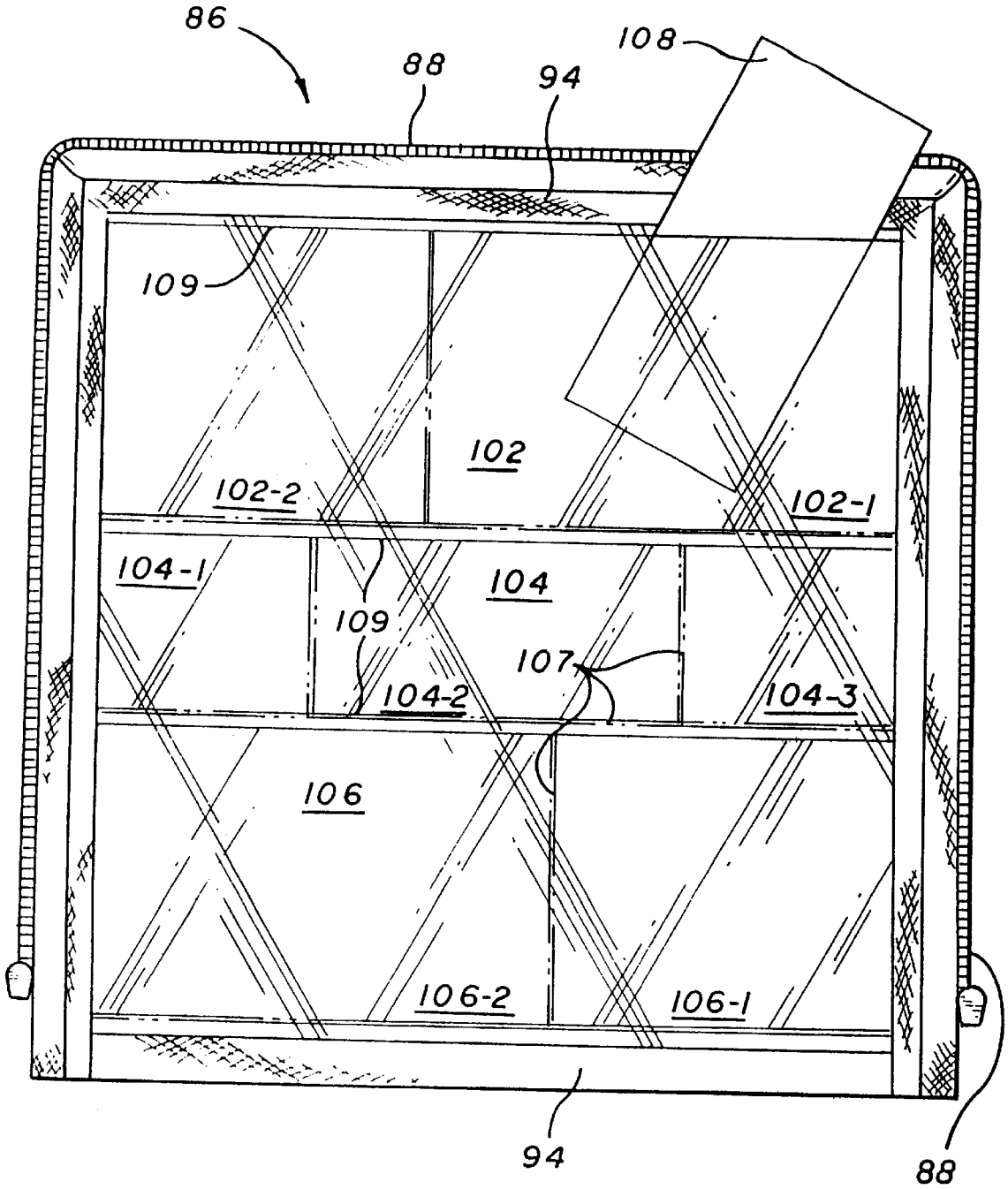
FIG. 7 is a plan view of the inside of the front window of the binder assembly of FIG. 6.

As best shown in FIG. 7, the inner surface of the window 92 of the window assembly 86 has a series of flexible transparent strips 102, 104 and 106 bonded thereto, forming additional small display pockets. These strips 102, 104 and 106 are bonded to the larger flexible sheet 92 to form a series of small pockets open at the top but bonded to the sheet 92 along the other three edges of each pocket.

Thus, considering the strip 104, it is formed into three small pockets 104-1, 104-2 and 104-3. Now, concerning pocket 104-2, note that it is bonded to transparent sheet 92 along lines 107 but is open at edge 109, to receive small visible inserts.

Similarly, strip 102 is bonded to sheet 92 to form pockets 102-1 and 102-2; and strip 106 is bonded to sheet 92 to form pockets 106-1 and 106-2, which are also open at their top edges but closed at the other three edges. Note, for example, that the business card 108 may be inserted into the pocket 102-2. The card would normally be oriented to face out so as to be visible from the front of the binder when the binder assembly is entirely closed up.

With the arrangements as shown in FIGS. 6 and 7, a large background visual display may be placed between the window assembly 86 and the front cover 87 of the binder assembly, and smaller visual displays placed in selected ones of the smaller display pockets shown in FIG. 7. These smaller visual displays would appear to be super-posed on the larger background visual display when viewed from the front of the binder.

Although the present invention has been described in terms of the preferred embodiments above, numerous modifications or additions to the above-described preferred embodiments would be readily apparent to one skilled in the art. Thus, by way of example and not of limitation, the binder is preferably sized to hold standard eight and a half by eleven inches sheets of paper. However, the binder may also be sized to accommodate sheets larger or smaller than eight and a half inches by eleven inches. For example, typical carry-type organizers and calendars are usually about five inches by seven inches, while binders for photo albums can be about twelve inches by fifteen inches. As another example, one exemplary binder is shown to include five small transparent pockets, and another binder includes seven small pockets. However, a binder may be constructed to have any number of small transparent pockets. It is further noted that the binder could be provided with a frame or pocket arrangement only on either the spine or the front cover, as well as with both, as shown in one preferred embodiment. Furthermore, visual displays and associated closures may be provided on the back cover of the binder as well as on the front cover, and/or the spine of the binder. Accordingly, the present invention is not limited to the specific embodiment illustrated and described hereinabove.

What is claimed is:

1. A versatile cover display binder assembly comprising:

a binder having front and rear covers pivotally secured together;

a window assembly having four sides; said window assembly having one side thereof; secured to one side of said front cover; and closures for selectively securing the other three sides of said window assembly to the other three sides of said front cover; and said window assembly including a transparent layer and a plurality of small transparent pockets formed by flexible transparent sheet material bonded to the inner surface of said transparent layer;

whereby said window assembly may be pivoted out from said front cover so that small visual images may be placed in said small transparent pockets and a large background sheet placed between said window assembly and said front cover.

2. A versatile cover display binder as defined in claim 1 wherein said closure is a zipper extending along three sides of said window assembly and said front cover.

3. A versatile cover display binder comprising:

a binder having front and rear covers pivotally secured to a spine;

a window assembly mounted on said front cover;

said window assembly including a transparent layer, and a frame or binding around the edge of said window assembly;

at least one side of said window assembly being permanently secured to one side of said front cover;

the remainder of the periphery of said window assembly being releasably secured to the periphery of said front cover to permit the insertion of visual material between said transparent layer and said cover and to provide a high strength closure between said window assembly and said front cover to provide a high strength unitary binder following insertion of said visual material and the securing of said window assembly to said front cover.

4. A versatile cover display binder as defined in claim 3 wherein said window assembly is secured to said cover by a zipper along at least one side thereof.

5. A versatile cover display binder as defined in claim 3 wherein said transparent layer has at least one small transparent pocket secured thereto.

6. A versatile cover display binder as defined in claim 5 wherein said closure extends around three sides of said window assembly to facilitate insertion of visual material into said small pocket.

7. A versatile cover display binder as defined in claim 3 wherein said closure includes a zipper extending along the corner of said binder between said front cover and said spine.

8. A versatile cover display binder as defined in claim 7 wherein said spine is provided with a transparent outer window and said zipper permits the insertion of visual material behind said spine window.

9. A covered binder assembly comprising:

a front cover, a rear cover and a spine connecting said front and rear covers;

said front cover having a first transparent sheet bonded to said cover and spanning substantially over said cover to form a front cover pocket between said cover and said first transparent sheet;

said spine includes a spine support connecting said front and rear covers, and a second transparent sheet bonded to said spine support and spanning substantially over said inner support to form a spine pocket between said spine support and said second transparent sheet;

an opening extending at least along one side of said first transparent sheet to provide access to said front cover pocket and said spine pocket; and a closure arrangement for closing said opening.

10. A covered binder assembly as defined in claim 9, further comprising additional transparent sheet material mounted on and bonded to said first transparent sheet to form a plurality of small pockets on said front cover.

11. A versatile cover display binder comprising:

a binder having a front cover and a rear cover pivotally secured to said front cover;

a window assembly mounted on said front cover;

said window assembly including a transparent layer, and a frame around the edges of said transparent layer;

one side of said window assembly being permanently secured to said front cover;

the other three sides of said window assembly being releasably secured by a zipper to said front cover to permit the insertion of visible material between said transparent layer and said front cover;

a three ring assembly for mounting papers mounted within said binder; and a second zipper extending around three sides of said front and rear covers for selectively closing said binder.

12. A versatile cover display binder as defined in claim 11 wherein said front cover and said rear cover are covered with fabric material, and said frame is formed of fabric material.

13. A versatile cover display binder as defined in claim 11 wherein said front cover includes a stiff inner base plate.

14. A versatile cover display binder as defined in claim 11 further comprising additional transparent pockets formed on the inside of said transparent layer.

* * * * *